US005222763A

United States Patent [19]

Garza

[11] Patent Number: 5,222,763

[45] Date of Patent: * Jun. 29, 1993

[54] NOTEPAD

[76] Inventor: Raul G. Garza, 12 Ollerton, Conroe, Tex. 77303

[ * ] Notice: The portion of the term of this patent subsequent to Aug. 4, 2007 has been disclaimed.

[21] Appl. No.: 923,216

[22] Filed: Jul. 31, 1992

Related U.S. Application Data

[63] Continuation-in-part of Ser. No. 684,218, Apr. 12, 1991, Pat. No. 5,135,259.

[51] Int. Cl.[5] ..... B42D 3/00

[52] U.S. Cl. ..... 281/29; 281/15.1; 283/58; 283/64.1

[58] Field of Search ..... 281/2, 3.1, 4.1, 15.1, 281/29, 31, 35, 37; 283/58, 64.1; 434/410

[56] References Cited

U.S. PATENT DOCUMENTS

D. 28,911 6/1898 Wiggins ..... 281/4.1 X
237,223 2/1881 Wight ..... 281/4.1 X
5,135,259 8/1992 Garza ..... 281/29

*Primary Examiner*—Mark Rosenbaum
*Assistant Examiner*—, Jr. Fridie
*Attorney, Agent, or Firm*—Harrison & Egbert

[57] ABSTRACT

A notepad having a plurality of sheets affixed together along a common edge and a backing layer affixed to the plurality of sheets. The plurality of sheets are adhered together by an adhesive of a quality suitable for permitting the separation of one sheet from another without tearing. The backing layer has a front side and a back side. The plurality of sheets are positioned adjacent to the front side. The backing layer has one surface dimension greater than a corresponding surface dimension of the plurality of sheets so as to form a display area extending outwardly of the plurality of sheets. The display area has a score line extending thereacross so as to define an upper portion and a lower portion. The upper portion of the display area is foldable relative to the lower portion of the display area. The display area is suitable for receiving advertising indicia printed thereon.

18 Claims, 3 Drawing Sheets

NOTEPAD

RELATED APPLICATIONS

The present application is a continuation-in-part of U.S. patent application Ser. No. 07/684,218, filed on Apr. 12, 1991, now U.S. Pat. No. 5,135,259 and entitled "NOTEPAD FOR CHECKBOOKS", presently pending.

TECHNICAL FIELD

The present invention relates to notepads. More particularly, the present invention relates to notepads having a writing area thereon and a display area thereon.

BACKGROUND ART

In present checkbooks and appointment books [such as DAYTIMERS TM ], it is often difficult to carry out computations, record information, and otherwise balance the checkbook without having an adjacent sheet of paper. Many times, checkbook users must conduct mathematical computations in the margins surrounding the checks, or in the ledger portion of checkbooks. Beyond the unsightly appearance of such margin calculations, these additional markings can create problems for banks and other persons that would process such checks. The appearance of these unsightly calculations within the ledger sheet could confuse the user and cause miscalculations in balancing one's checkbook.

Many present day checkbooks incorporate a calculator within the checkbook cover. Although this aids in the computation of various matters associated with checking activities, calculators are cumbersome and will not record a variety of information. In addition, calculators cannot be easily folded or stuffed into one's pocket haphazardly. Many times, calculators will run out of power, or will become defective with continued use. The use of calculators in conjunction with checkbooks is a costly endeavor by the checkbook manufacturer and is generally found to be unsuitable for consumer use.

A magic slate was developed by the present inventor which fastens to the interior of a checkbook. This invention was patented as U.S. Pat. No. 4,911,476 on Mar. 27, 1990. This information pad for checkbooks included a checkbook cover having a flexible material and an information receiving pad that was flexibly fastened to an edge of the checkbook cover. The checkbook cover is a type that has a suitable slot for receiving checkbooks. The information pad has an area that is less than the area of the checkbook cover. The information receiving pad included an impression layer, a flexible translucent adhering sheet, a flexible transparent sheet, and a slip coating. A hinge member extended between the edge of the impression layer and the edge of the checkbook cover so as to allow the information receiving pad to be folded within the cover.

After experimentation, it was found that most checkbook covers are made of polyvinyl chloride. Additionally, plasticizers and other chemicals are incorporated into the polyvinyl chloride of the checkbook covers so as to make the checkbook cover soft and flexible. These plasticizers are very effective in simulating the feel and quality of leather. However, when plasticizers are used in the formation of the checkbook cover, it becomes very difficult to apply adhesives to the checkbook cover. Generally, adhesive tape will not stick to the checkbook cover. If it does stick, then it would not withstand the loads placed upon it. If adhesives of great strength are used, then such adhesives make it impossible to remove the pad and also cause the paper to tear. It is extremely important to have the proper balance of adhesive strength versus the material that is used in the notepad.

It is virtually impossible to obtain a notepad that can fasten to a checkbook cover or to an appointment book cover. Typical, "POST-IT TM " pads are unsuitable for affixing to the plasticized covers. The adhesive strength in the "POST-IT TM " pads is less than three ounces per inch of width. Although the "POST-IT TM " pads stick, for a very short period of time, to the cover, they do not withstand the loads placed upon it. In a very short time, the "POST-IT TM " pad will no longer adhere to the checkbook cover. No other notepads having adhesives of greater strength, are available for this purpose.

Although the "POST-IT TM " pads are unsuitable for use with checkbook covers, their use is particularly desirable. Because of the disposable and/or reusable nature of such sheets of a "POST-IT TM " pad, they are quite appropriate for use in checkbooks, notebooks, and other items. Therefore, it is desirable to have a manner in which such "POST-IT TM " pads can be either mechanically and/or adhesively retained within a checkbook or notepad.

It is an object of the present invention to provide a notepad which includes an advertising display area.

It is another object of the present invention to provide a notepad that can be more securely fastened within a foldable plasticized cover.

It is another object of the present invention to provide a notepad that can be removed and replaced universally.

It is still a further object of the present invention to provide a adhesive pad which has an outwardly extending backing layer for the display of information.

These and other objects and advantages of the present invention will become apparent from a reading of the attached specification and appended claims.

SUMMARY OF THE INVENTION

The present invention is a notepad that comprises a plurality of sheets which are adhesively affixed together along a common edge and a backing layer which is affixed to the plurality of sheets. The plurality of sheets are joined together by an adhesive of a quality suitable for allowing the separation of one sheet from another without tearing. Such plurality of sheets is in the nature of the commonly known "POST-IT TM " pads. The backing layer has a front side and a back side. The plurality of sheets is adjacent to the front side. The backing layer has one surface dimension which is greater than a corresponding surface dimension of the plurality of sheets.

The plurality of sheets has a first surface dimension which extends transversely to the common edge. The surface dimension of the backing layer is greater than this surface dimension of the plurality of sheets. The backing layer has a width which is equal to a length of the common edge. The backing layer includes a display area which extends outwardly beyond the plurality of sheets. A score line is formed on the display area and extends thereacross. This score line defines an upper portion and a lower portion of the display area. The upper portion is foldable relative to the lower portion of the display area. The display area has advertising indicia printed on a front side of the backing layer. The backing layer also has an edge opposite to the display area. This edge is generally flush with an edge of the plurality of sheets.

In an alternative embodiment of the present invention, an adhesive strip may be fastened to the back side or front side of the backing layer. This adhesive has an adhesive surface on one side opposite the backing layer. The adhesive strip has an adhesive strength of between 5 ounces per inch of width and 85 ounces per inch of width. The adhesive strip extends longitudinally along this backing layer. The adhesive strip has an adhesive coating on one side which is of greater strength than the adhesive coating on another side.

DETAILED DESCRIPTION OF THE INVENTION

Figure 1:
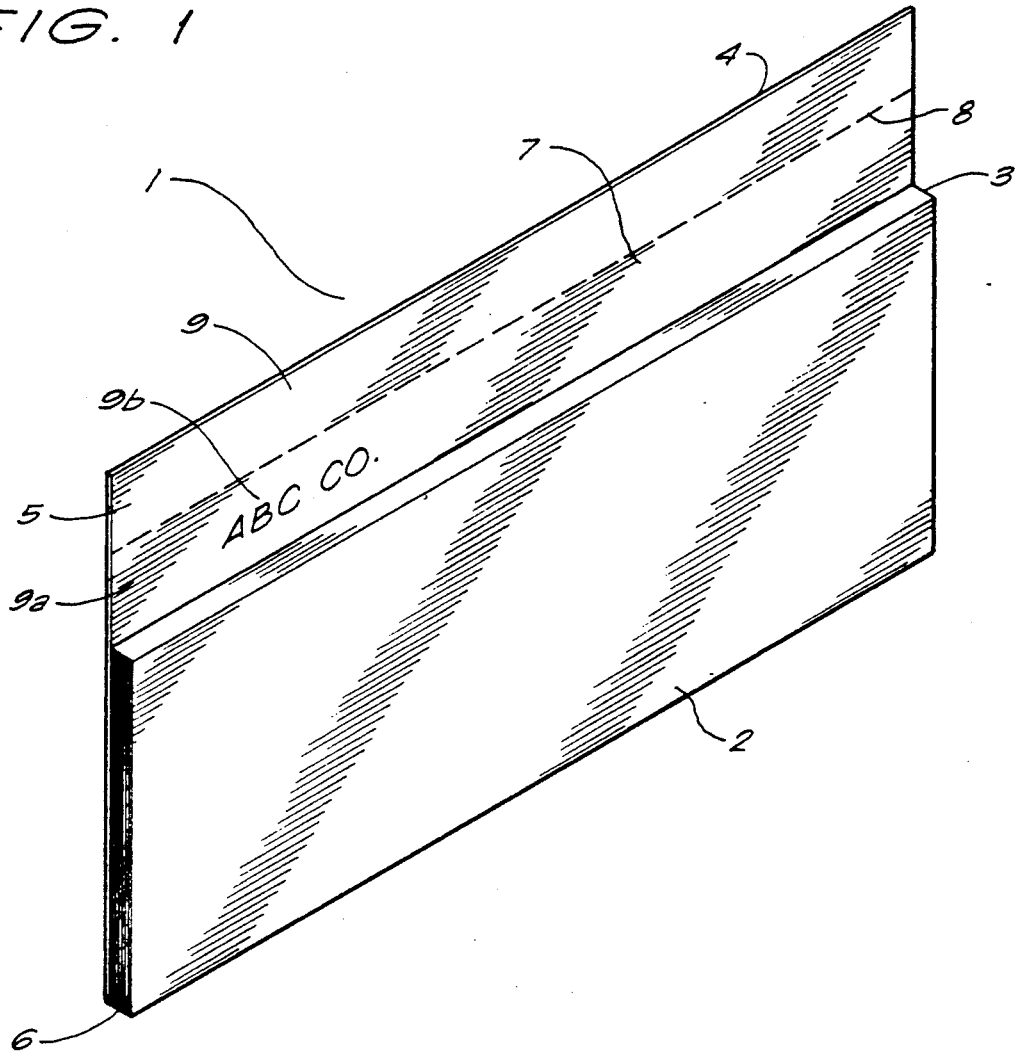
FIG. 1 is a perspective view of the preferred embodiment of the notepad of the present invention.

Referring to FIG. 1, there is shown at 1 the preferred embodiment of the notepad in accordance with the present invention. It can be seen that notepad 1 includes a plurality of sheets 2 which are adhesively affixed together along a common edge 3. As will be described herein, the plurality of sheets 2 has an adhesive which joins the sheets together along the common edge 3. This adhesive has a quality suitable for allowing the separation of one sheet from another without tearing. Typically, the plurality of sheets 2 has a configuration similar to commonly known "POST-IT TM" pads.

In FIG. 1, it can be seen that there is a backing layer 4 which is affixed to the plurality of sheets 2. The backing layer 4 has a front side 5 and a back side. The plurality of sheets 2 are affixed adjacent to the front side 5 of the notepad 1. It can be seen that the backing layer 5 has at least one surface dimension which is greater than a corresponding surface dimension of the plurality of sheets 2. In particular, the length of the backing layer 5 is greater than the length of the plurality of sheets 2 as measured from the common edge 3 to the bottom edge 6. It can easily be seen that the width of the backing layer 4 is equal to the length of the common edge 3.

Because the backing layer 4 has a length greater than the plurality of sheets 2, a display area 7 is shown by this outwardly extending portion. A score line 8 extends across the display area 7 so as to form an upper portion 9 and a lower portion 9*a*. It can be seen that advertising indicia 9*b* is printed on the front side of the backing layer 4 in the area of the lower portion 9*a* of display area 7.

In general, the score line 8 is formed on the display area 7. The score line 8 makes it a much simpler task to fold the upper portion 9 with respect to the lower portion 9*a*. Since the upper portion 9 may be folded rearwardly of the notepad 1, it is proper to include the advertising indicia 9*b* on the lower portion 9*a*. However, it is possible, within the scope of the present invention, that the advertising indicia 9*b* can extend across the surface of the display area 7. The illustration of FIG. 1 is not intended as a limitation on the present invention with respect to the location of the printing of the advertising indicia 9*b*.

In FIG. 1, it can be seen that the backing layer 4 has a width which is flush with the width of the plurality of sheets. Additionally, the bottom edge of the backing layer 4 is flush with the bottom edge 6 of the plurality of sheets 2. In this manner, the notepad 1 has a neat and attractive configuration.

Figure 2:
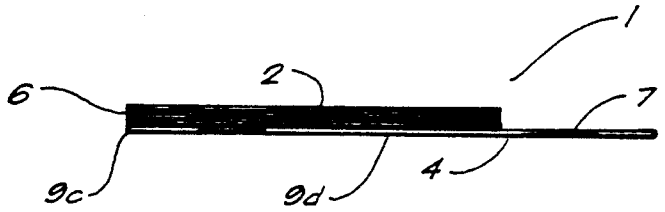
FIG. 2 is a side view of the notepad of the present invention.

FIG. 2 shows the arrangement of the plurality of sheets 2 with respect to the backing Layer 4. In general, the backing layer 4 will have greater rigidity than any of the individual sheets within the plurality of sheets 2. The bottom edge 9*c* of the backing layer 4 is shown as flush with the bottom edge 6 of the plurality of sheets 2. The display area 7 is appropriately printed on the top surface of the backing layer 4. The back surface 9*d* of the backing layer 4 is generally flat. However, in the alternative embodiment of the present invention, which is to be described hereinafter, the back surface 9*d* of the backing layer 4 may include an appropriate adhesive strip.

Figure 3:
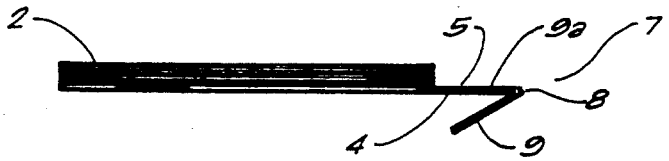
FIG. 3 is a side view of the notepad of the present invention showing the foldability of the display area.

FIG. 3 shows the operation of the score line 8 on the backing layer 4. The score line 8 allows the upper portion 9 to be folded relative to the lower portion 9*a* of the display area 7. In this manner, the downwardly folded upper portion 9 can be suitably inserted into a slot or otherwise received within a checkbook and/or notepad. The plurality of sheets 2 are shown as fastened to the top surface 5 of the backing layer 4.

Figure 4:
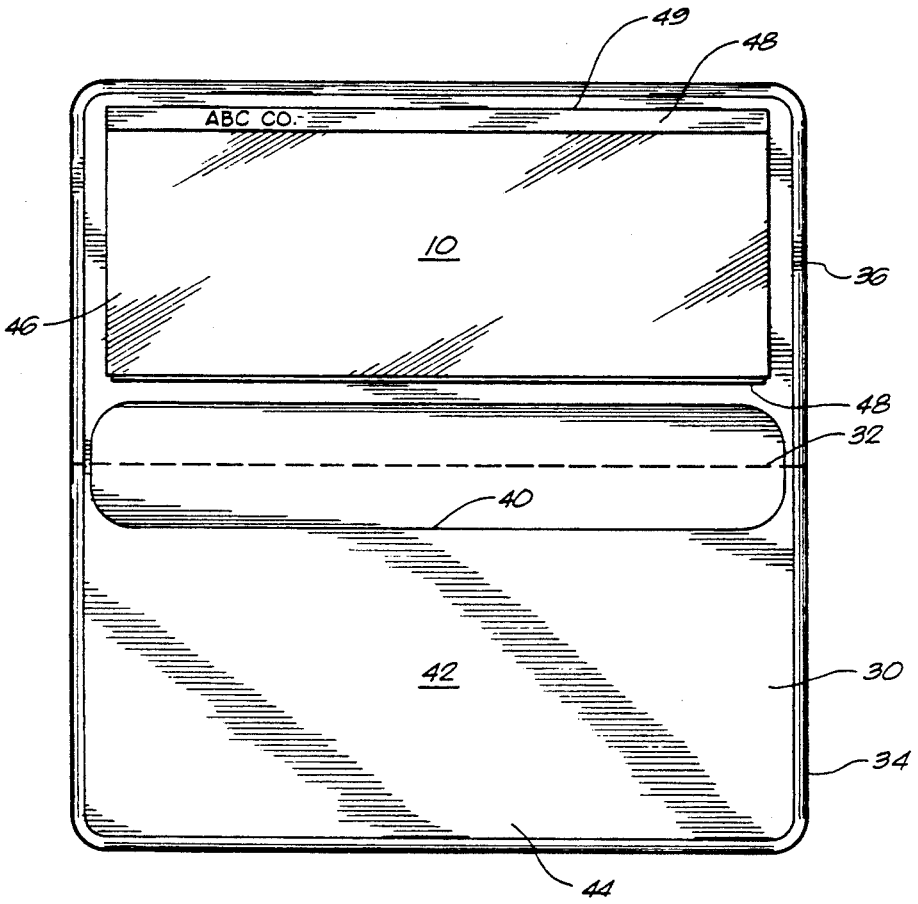
FIG. 4 is a full view in side elevation showing the notepad as affixed within the area of the checkbook cover.

Referring to FIG. 4, the appearance of the checkbook cover 30 can be seen. In particular, it can be seen that the first section 34 and the second section 36 can be folded along fold line 32. A slot 40 is provided in the first section 34 so as to receive the back cover of a checkbook. The checkbook will reside in area 32 on the first section 34. A plastic liner 44 may be provided along the inner surface of the checkbook cover 30. As can be seen, the checkbook cover 30 has a generally rectangular configuration. The notepad 10 is affixed within a slot on the inner surface of the second section 36 of checkbook cover 30. A first sheet 46 is provided in a proper position for use by the user of the checkbook 30. All of the sheets 46 are connected along a common edge 48. After the first sheet 46 is used, the sheet 46 can be removed so as to expose the second sheet 48 therebelow. Such a process continues until the notepad 10 is used up. After the notepad 10 is used up, the entire notepad 10 can be removed by pulling the backing layer from the slot adjacent an edge of the checkbook cover 30. It can also be seen that the notepad 10 has an area that is less than half of the total surface area of the checkbook cover 30. In this configuration, the first section 34 and the second section 36 of checkbook cover 30 can be folded onto itself so as to cover the exposed portions of the notepad 10. When folded, the notepad 10 and a checkbook contained in slot 40 on surface 42 will be in face-to-face relationship. One of the important advantages of the present invention is that it has a flexible hinge to use as a locator or, when checkbook (or other apparatus) is open, a writing pad is presented so as to face the user.

Figure 5:
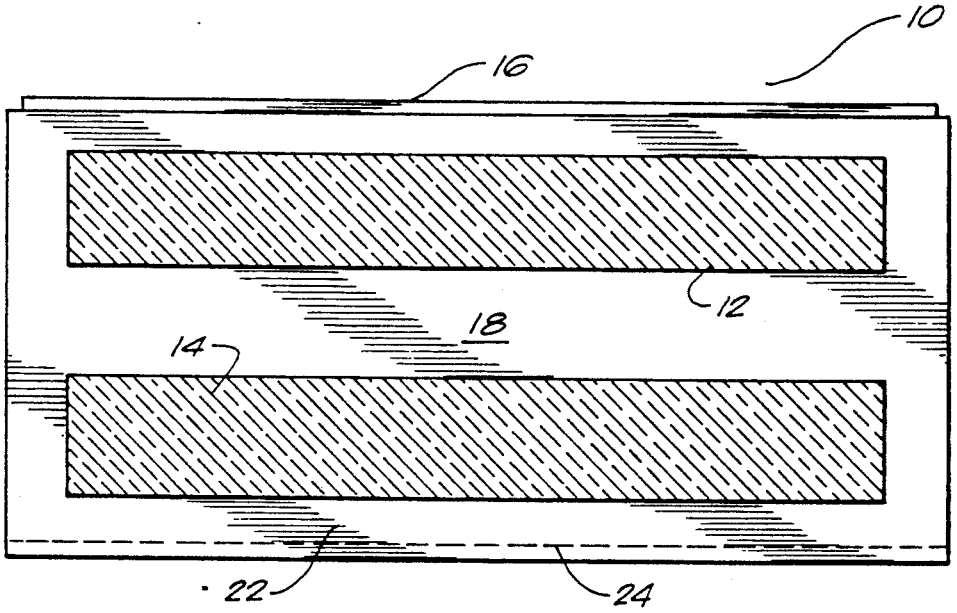
FIG. 5 is a rear view of the notepad in accordance with the alternative embodiment of the present invention.

Referring to FIG. 4, there is shown at 10 the notepad in accordance with an alternative embodiment of the present invention. Notepad 10 comprises a first adhesive strip 12, a second adhesive strip 14, a plurality of sheets 16, and a backing layer 18. The plurality of sheets 16 are affixed together along a common edge. The backing layer 18 is connected to this plurality of sheets 16. The backing layer 18 has a front side and a back side. The back side 22 is illustrated in FIG. 5. The plurality of sheets 16 are positioned adjacent to the front side of the backing layer.

Adhesive strip 12 may fastened to the back side or the front side of backing layer 18. The adhesive strip 12 includes an adhesive surface on the side opposite to the backing layer 18. The adhesive strip 12 has an adhesive strength of between five ounces per inch of width and eighty-five ounces per inch of width, based upon an D3330 ASTM peel adhesion test rating for a 180° peel test.

A second adhesive strip 14 is also fastened in another location to the backing layer 18. The second adhesive strip 14 has an adhesive strength that is equal to that of the first adhesive strip 12. The second adhesive strip 14 is arranged in parallel relationship with the first adhesive strip. Both the first adhesive strip 12 and the second adhesive strip 14 extend longitudinally across the backing layer 18. Each of the adhesive strips 12 and 14 are adhesively fastened to the back side 22 of backing layer 18.

Figure 6:
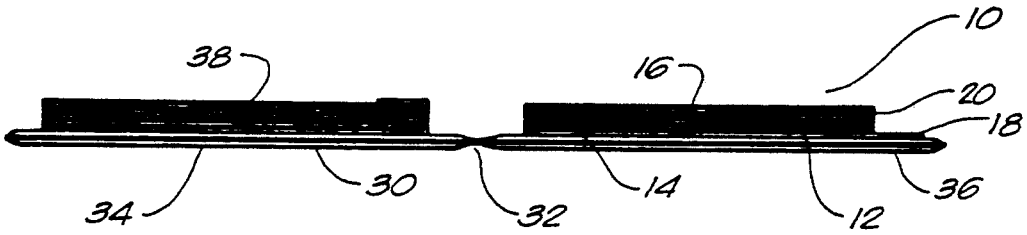
FIG. 6 is a side view showing an open checkbook cover with the notepad attached in its desired position.

FIG. 6 illustrates the configuration of the notepad 10 as fastened to a checkbook cover 30. As used herein, the term "checkbook cover" refers to actual checkbook covers, to appointment book covers, and to similar foldable flexible plasticized covers. Checkbook cover 30 has a generally flat configuration. The checkbook cover 30 narrows at hinge point 32 such that the first second 34 of checkbook cover 30 and the second section 36 of checkbook cover 30 can fold over onto one another. The checkbook cover 30 is generally composed of a plasticized material. In particular, the checkbook cover 30 is made of polyvinyl chloride material having plasticizers contained therein.

Typically, liquids are added in quantity as plasticizers to economize, improve processability, soften, or improve low-temperature performance of organic compounds. A soft (thirty to forty durometer) polychloroprene (neoprene) compound, because of its high softening-oil content, will be expected to be much more difficult to bond than harder stocks. A polychloroprene stock plasticized to pass a −67° F. brittleness test will be expected to be much more difficult to bond than an unplasticized stock. Similarly, if the harder, or "unplasticized" stocks have been extended by high aromatic-oil loading to reduce costs, the bonding may also be seriously and negatively affected.

Besides curing systems, fillers, and plasticizers, a compound used in the checkbook cover may contain protective chemicals such as antioxidants, antiozonants, waxes, and fungicides. Some of these are designed to migrate to the surface of the compound and form a protective layer or "bloom". Other compounding ingredients may unintentionally bloom sulphur from the cure system, for example. Liquids and solids in elastomers form liquid-liquid or solid-liquid (rubber is considered a liquid) systems which may easily become saturated. In such cases, excess compounding ingredients will also migrate to the surface. It is not hard to ascribe effects on adhesion and surface preparation prior to adhesion to such blooming conditions.

As such, the checkbook cover 30 contains these plasticizers, and other ingredients, that makes adhesion, by adhesives, quite difficult.

Also, in FIG. 6, there is shown the notepad 10 as affixed to the second section 36 of checkbook cover 30. The notepad 10 can affixed inserting the folded display area into the slot formed along the edge of the checkbook cover or, in the alternative embodiment, it can be adhesively fasten by strips 12 and 14. It can be seen that the backing layer 18 includes a plurality of sheets 16 fastened along the common edge 20. The checkbook 38 is fastened to the first section 34 of checkbook cover 30. Typically, the checkbook 38 will have its back cover slidably positioned within a slot formed on the inside of the checkbook cover 30.

Each of the adhesive strips 12 and 14 (shown in FIG. 5) are "pressure- sensitive adhesives". The term "pressure-sensitive adhesive" refers to that type of adhesive which, when in a dry state, will adhere to a variety of surfaces merely by the application of light hand pressure. Such compositions are inherently soft tacky materials which exhibit a balance of adhesive and cohesive strength depending on the viscoelastic nature of the adhesive and the performance requirements of the particular end use. When applied to the inner surface of a checkbook cover, it is important to the performance of the present invention that the peel adhesion be such as to allow the notepad 10 to be positioned in a fixed manner to the checkbook cover while, at the same time, allowing the notepad to be removed without leaving residual material on the interior of the cover 10. In accordance with D3330 ASTM peel adhesion test standards, peel adhesion is determined by measuring the force required to remove a pressure-sensitive material by peeling at a constant rate, usually at an angle of 180° F. to the substrate. In addition to the viscoelastic properties of the adhesive, other factors affecting peel adhesion are polarity of the adhesive, thickness of the bond, temperature, the length of time that the adhesive has been in contact with the surface, rate of removal, and the nature of both the substrate and the backing material. In experiments with the present invention, it has been found that the optimal performance of the adhesive strips 12 and 14 are when the adhesive surface of these strips has an adhesive strength of between five ounces per inch of width and eighty-five ounces per inch of width. The preferred embodiment is fifteen ounces per inch of width.

If the adhesive strength of the adhesive surface of strips 12 and 14 is less than five ounces per inch of width, then the notepad 10 will only adhere for a very brief length of time to the surface of the checkbook cover 30. However, if the adhesive strength is greater than eighty-five ounces per inch of width, then the adhesion to the checkbook cover will be too strong. As a result, when the notepad 10 is removed, it will leave marks on the inner surface of the checkbook cover 30. Also, if removal is attempted, then the paper will tear and remain attached to the checkbook cover. As such, after experimentation, it was found that the preferred embodiment is somewhere between these two limits. Ideally, after experimentation, it was found that an adhesive with a strength of fifteen ounces per inch of width can be removed without leaving unnecessary marks or causing the paper of the notepad 10 to tear. Also, the notepad will remain affixed in the desired position on the interior of the checkbook cover.

Figure 7:
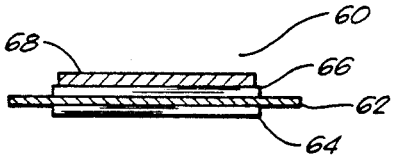
FIG. 7 is a greatly enlarged end view showing the configuration of a single adhesive strip as used in the alternative embodiment of the present invention.

FIG. 7 shows a side view, in greatly enlarged proportion, of a single adhesive strip 60. It can be seen that the adhesive strip 60 has a central plastic strip 62. Adhesive layers 64 and 66 are applied to each side of the plastic strip 62. The adhesive layer 64 will be positioned and permanently fastened to the backing layer 18 of the notepad 10. Since the purpose of the adhesive layer 64 is to permanently affix the adhesive strip 60 to the backing layer 18 of the notepad 10, the adhesive layer 64 may have an adhesive strength within the limits described herein previously or an adhesive strength of greater than 85 ounces per inch of width. The purpose of the adhesive layer 64 is to cause the adhesive strip 60 to be permanently fastened to the backing layer of the notepad 10.

The adhesive layer 66 is applied to the opposite side of the plastic strip 62. The adhesive layer 66 has the strength and the qualities described herein previously. The purpose of the adhesive layer 66 is to removably fasten the notepad 10 to the plasticized cover of the checkbook. As such, it is important that the adhesive layer 66 have the adhesive properties described herein previously. A thin piece of silicon-coated paper 68 is temporarily placed on the adhesive layer 66 on the side opposite to the plastic strip 62. The paper strip 68 is silicon coated so that it weakly adheres to the adhesive 66. The paper 68 serves to protect the adhesive 66 prior to the application of the notepad to the checkbook cover.

When it is desired to affix the notepad 10 to the checkbook 30, as shown in FIG. 3, then the paper strip 68 is removed from the adhesive 66. This will allow the adhesive strip 60 to properly adhere to the checkbook cover 30.

Figure 8:
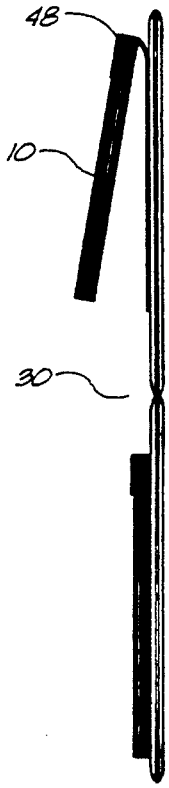
FIG. 8 is a side view of the open checkbook showing the position of the notepad.

FIG. 8 shows how the notepad 10 may be inserted into the slot at the top edge of the checkbook cover 30. The notepad 10 is free to hinge outwardly from the surface of the checkbook cover. The folded portion of the display area 48 is slidably positioned within the slot so as to secure the notepad in position.

The present invention offers an improved notepad of the type using sheets in a configuration commonly known as adhesive pads. In particular, the present invention utilizes a backing layer that has an outwardly extending portion. A display area is formed on this outwardly extending portion which is suitable for the receipt of advertising or other indicia. The backing layer also has a quality suitable for adherence to a checkbooks, notebook, or other cover. The display area can be folded upon itself so as to provide a suitable insert for a slot of a checkbook. The rigidity of the backing layer is suitable for the receipt of adhesives which can allow the backing layer to be affixed to the plasticized cover of a notebook or a checkbook. The configuration of the present invention can be manufactured and assembled relatively inexpensively.

The foregoing disclosure and description of the invention is illustrative and explanatory thereof. Various changes in the details of the illustrated apparatus ma be made within the scope of the appended claims without departing from the true spirit of the invention. The present invention should only be limited by the following claims and their legal equivalents.

I claim:

1. A notepad comprising:

a plurality of sheets adhesively affixed together along a common edge, said plurality of sheets having an adhesive of a quality suitable for separating one sheet from another without tearing;

a backing layer affixed to said plurality of sheets, said backing layer having a front side and a back side, said plurality of sheets adjacent said front side, said backing layer having a first surface dimension transverse to said common edge, said first surface dimension having a greater length than a corresponding surface dimension of said plurality of sheets transverse to said common edge.

2. The notepad of claim 1, said backing layer having a width parallel to said common edge, said width equal to a length of said common edge.

3. The notepad of claim 1, said backing layer having a display area extending outwardly beyond the common edge of said plurality of sheets, said plurality of sheets adhesively affixed together, said backing layer adhesively affixed to said plurality of sheets.

4. The notepad of claim 3, said display area having a score line extending thereacross parallel to said common edge, said score line for causing an upper portion of said display area to fold relative to a lower portion of said display area.

5. The notepad of claim 3, said display area having advertising indicia printed on said front side of said backing layer.

6. The notepad of claim 1, further comprising:

an adhesive strip fastened to said backing layer, said adhesive strip having an adhesive surface on one side opposite said backing layer.

7. The notepad of claim 6, said adhesive strip extending along an edge of said backing layer.

8. The notepad of claim 6, said adhesive strip having an adhesive coating on one side of greater strength than the adhesive coating on another side.

9. An apparatus comprising:

a cover of a flexible foldable plasticized material, said cover having at least one interior slot formed therein;

a plurality of sheets affixed together along a common edge;

a backing layer fastened to said plurality of sheets, said backing layer having a front side and a back side, said plurality of sheets adjacent said front side, said backing layer having a display area extending outwardly beyond said plurality of sheets, said display area foldable such that one portion of said display area engages said interior slot of said cover.

10. The apparatus of claim 9, interior slot extending adjacent an edge of said cover, said display area engaging said slot such that said plurality of sheets are positioned inwardly of said edge.

11. The apparatus of claim 10, said display area having advertising indicia printed on said front side of said backing layer, said advertising indicia appearing exterior of said slot.

12. The apparatus of claim 9, said backing layer having an area less than one-half of the area of said cover.

13. The apparatus of claim 12, said cover foldable over an entire exterior surface of said plurality of sheets.

14. The apparatus of claim 9, further comprising:

an adhesive strip fastened to said backing layer and to said cover, said adhesive strip having an adhesive surface fastened to said cover, said adhesive surface of said adhesive strip having an adhesive strength of between five ounces per inch of width and 85 ounces per inch of width.

15. The apparatus of claim 9, said plurality of sheets adhesively affixed together along a common edge, said plurality of sheets having an adhesive of a quality suitable for separating one sheet from another without tearing.

16. The apparatus of claim 9, said backing layer having greater rigidity than one of said plurality of sheets.

17. A notepad comprising:

a plurality of sheets adhesively affixed together along a common edge, said plurality of sheets having an adhesive of a quality suitable for separating one sheet from another without tearing; and a backing layer affixed to said plurality of sheets, said backing layer having a front side and a back side, said plurality of sheets being adjacent said front side, said backing layer having a display area extending outwardly beyond said plurality of sheets, said display area having advertising indicia printed on said front side.

18. The notepad of claim 17, said display area having a score line extending thereacross, said score line defining an upper portion and a lower portion of said display area, said upper portion foldable relative to said lower portion.

* * * * *